United States Patent [19]

König

[11] Patent Number: 4,728,579

[45] Date of Patent: Mar. 1, 1988

[54] WEAR RESISTANT, COATED, METAL CARBIDE BODY AND A METHOD FOR ITS PRODUCTION

[75] Inventor: Udo König, Essen, Fed. Rep. of Germany

[73] Assignee: Fried. Krupp Gesellschaft mit beschränkter Haftung, Essen, Fed. Rep. of Germany

[21] Appl. No.: 835,985

[22] Filed: Mar. 4, 1986

[30] Foreign Application Priority Data

May 3, 1985 [DE] Fed. Rep. of Germany ..... 3515919

[51] Int. Cl.[4] ..... B32B 15/04; C23C 14/34

[52] U.S. Cl. ..... 428/472; 428/698; 428/699; 428/627; 428/660

[58] Field of Search ..... 428/627, 660, 663, 665, 428/689, 698, 704, 908.8, 446, 472

[56] References Cited

U.S. PATENT DOCUMENTS

| | | | |
|---|---|---|---|
| 3,120,453 | 2/1964 | Fitzer et al. | 428/698 X |
| 3,640,689 | 2/1972 | Glaski et al. | 29/195 |
| 4,018,631 | 4/1977 | Hale | 428/698 X |
| 4,066,821 | 1/1978 | Cook et al. | 428/698 |
| 4,162,345 | 7/1979 | Holzl | 428/698 X |

FOREIGN PATENT DOCUMENTS

| | | | |
|---|---|---|---|
| 2528255 | 2/1976 | Fed. Rep. of Germany . | |
| 336905 | 6/1977 | Fed. Rep. of Germany . | |
| 342324 | 3/1978 | Fed. Rep. of Germany . | |
| 4717634 | 2/1971 | Japan | 48/698 |
| 542678 | 11/1973 | Switzerland . | |
| 572101 | 1/1976 | Switzerland . | |

*Primary Examiner*—Nancy A. B. Swisher

*Attorney, Agent, or Firm*—Spencer & Frank

[57] ABSTRACT

A wear resistant, coated, metal carbide body comprising a metal carbide basic body, a metallic intermediate layer and at least one metal-free hard substance layer; wherein the metallic intermediate layer comprises molybdenum and/or tungsten, has a thickness of 0.1 to 2 μm and is applied to the metal carbide basic body by means of a physical vapor deposition process, preferably by direct cathode sputtering. During the application of the intermediate layer, the metal carbide basic body has a temperature from 200° to 600° C.

12 Claims, No Drawings

WEAR RESISTANT, COATED, METAL CARBIDE BODY AND A METHOD FOR ITS PRODUCTION

BACKGROUND OF THE INVENTION

The present invention relates to a novel wear resistant, coated, metal carbide body comprising a metal carbide basic substrate body, a metallic intermediate layer and at least one metal-free hard substance layer. The invention also relates to a method for producing the novel metal carbide body.

German Published Patent Application No. DE-OS 2,528,255 discloses utilitarian and decorative articles that have been coated with hard substances to a thickness of 0.1 to 50 μm, the hard substances being carbides, nitrides, borides, silicides, oxides of elements of Groups III to VI of the Periodic Table, or combinations thereof. DE-OS No. 2,528,255 further proposes to improve the adhesion of the hard substance coatings and to reduce thermal stresses by applying one or a plurality of intermediate layers of metals, alloys of metals and hard substances, or hard substances. The basic substrate materials for these known utilitarian and decorative articles may be metallic or nonmetallic substances, such as steel, castable substances, colored metals, light metals, metal carbides, glass or ceramics.

The known utilitarian and decorative articles may be produced by applying the intermediate and cover layers in succession onto the basic body by gas phase reaction according to the chemical vapor deposition (CVD) process, wherein the layers are precipitated onto the basic body as a result of chemical reactions taking place in the gas phase.

Swiss Pat. No. 542,678 discloses a composite substance for cutting tools. This substance comprises a metallic or nonmetallic substrate, at least one intermediate layer and a wear resistant cover layer, in which the intermediate layer exhibits the following characteristics:

(a) its average hardness lies between the hardness of the substrate and the hardness of the cover layer;
(b) it is more ductile than the cover layer;
(c) its average coefficient of thermal expansion lies between that of the substrate and that of the cover layer;
(d) it is partially dissolved in the substrate as well as in the cover layer;
(e) its average grain size is substantially less than the layer thickness.

The composite substance disclosed in Swiss Pat. No. 542,678 is produced by precipitating the material for the intermediate layer from the gas phase onto the substrate by chemical reaction, with the material of the substrate and the material of the intermediate layer diffusing into one another. The cover layer, in turn, is precipitated from the gas phase onto the intermediate layer, with the material of the cover layer and the material of the intermediate layer diffusing into one another.

It has been found that coated metal carbide bodies comprising a metal carbide basic body, a metallic intermediate layer and at least one metal-free hard substance layer, which are formed through precipitation by chemical reaction from the gas phase as taught in the prior art, have wear characteristics that preclude their use as tools for the machining and shaping by non-cutting means of metal workpieces. My own experiments, for example, have shown that the wear resistance of a titanium nitride layer precipitated from the gas phase onto a metal carbide basic body is reduced by an intermediate layer of nickel, cobalt or titanium, which is likewise precipitated from the gas phase.

SUMMARY OF THE INVENTION

It is, therefore, an object of the present invention to provide a wear resistant, coated, metal carbide body, comprising a metal carbide basic body, a metallic intermediate layer and at least one metal-free hard substance layer, which has wear characteristics that permit its use as a tool for machining and shaping by non-cutting means of metallic workpieces.

This object is accomplished by using a metallic intermediate layer comprising molybdenum and/or tungsten, in a thickness of from 0.1 to 2 μm, applied to the metal carbide basic body by means of a physical vapor deposition (PVD) process, wherein the metal carbide body is maintained at a temperature from 200° to 600° C. during the application of the intermediate layer. According to a PVD process, the substrate is coated by a physical method, such as vapor deposition, cathode sputtering, electric arc sputtering and the like. A body produced in this manner has wear characteristics that permit its use as a tool for machining and shaping metal workpieces by non-cutting means.

DESCRIPTION OF THE PREFERRED EMBODIMENTS

According to the present invention, it is particularly advantageous if the metallic intermediate layer comprising molybdenum and/or tungsten is applied to the metal carbide basic body by direct cathode sputtering, since this PVD process achieves an especially uniform precipitation of the molybdenum and/or tungsten layer onto the metal carbide basic body. The characteristics of the intermediate layer according to the present invention can be varied in an advantageous manner by replacing 0.1 to 49 weight percent of the molybdenum and/or tungsten with titanium, zirconium, hafnium, niobium or tantalum, or combinations of two or more thereof.

Metal carbide bodies according to the invention have metal-free hard substance layers comprised of carbides, nitrides, borides, silicides, or oxides of metals selected to have particularly great hardness and high melting points. Some examples of hard substances to be used are titanium carbide, titanium nitride, titanium boride and aluminium oxide, which have Vickers hardnesses in the range from 2000 HV to 3400 HV and melting points from 2060° C. to 3067° C.

The preferred hard substances to be used in the invention are titanium carbide, titanium nitride, titanium carbonitride or aluminum oxide, zirconium oxide, boron carbide, silicon carbide, titanium diboride, or combinations thereof, which have demonstrated particularly good wear characteristics. The most preferred hard substances are titanium carbide, titanium nitride, titanium carbonitride and aluminum oxide.

The metal carbide basic bodies are composed of two phases, a binder metal phase comprising iron, cobalt or nickel, or combinations thereof, and a hard substance phase, dispersed in the binder metal phase, comprising one or more hard substances as defined above, preferably hard carbides of tungsten, titanium, niobium and/or tantalum. The metal carbide basic bodies may be produced by casting, by powder-metallurgical processes, or by equivalent processes. The metal carbide bodies are known as cemented carbides. The cemented carbides for a variety of applications are classified in the standard ISO 513 of the International Organization for Standardization. For the use as substrate material for coated inserts for cutting tools the grades M15, P25 and K10 are very suitable. The typical compositions and the graine size of the carbides of these grades are given in the following:

| grade to ISO 513 | CO | (weight - %) WC | (Ti, Ta, Nb) | grain size (μm) |
|---|---|---|---|---|
| K10 | 6 | 94 | — | 1–2 |
| M15 | 6.5 | 82.5 | 11 | 2–4 |
| P25 | 10 | 72.5 | 17.5 | 3–6 |

The object of the present invention is further accomplished by a process for producing the wear resistant, coated, metal carbide body in which the metallic intermediate layer is applied to the metal carbide basic body in a PVD process, with the metal carbide basic body being heated to a temperature from 200° to 600° C. during application of the intermediate layer. Surprisingly, I found that intermediate layers of molybdenum and/or tungsten impart excellent adhesion to the hard substance layers, although no diffusion takes place between the metal carbide basic body and the metallic intermediate layer at the process temperatures of the present invention. Such diffusion had been considered in the past to be a prerequisite for good adhesion between the layers.

According to the invention, it is particularly advantageous to apply the metallic intermediate layer to the metal carbide basic body by direct cathode sputtering, since such a PVD process results in a particularly uniform precipitation of the intermediate layer.

As a further feature of the invention, it is provided that at least one metal-free hard substance layer is applied to the metallic intermediate layer by reactive cathode sputtering or by gas phase reaction. The application of hard substance layers by reactive cathode sputtering or by gas phase reaction is known in the art.

The cathode sputtering process is exemplified as follows:

In a vacuum vessel containing argon and kept at a pressure of about $10^{-2}$ mbar, there is disposed a planar, circular or rectangular target plate. The substrates to be coated are positioned on a substrate plate at a distance of a few cm from the target. An electrical field between target and substrate plate causes partial ionization of the gas contained in the vacuum vessel. A strong pot magnet is provided behind the target plate. The field lines of this magnet force the free electrons of the plasma in front of the target into circular or spiral paths, with the planes of the electron paths being approximately parallel to the target plate. Due to the circular paths of the electrons, the ionization density is increased significantly and it is possible to operate with relatively low gas pressures. Sputtering of the target is effected by the positive argon ions which are accelerated by the electrical field. The sputtered atoms or atom groups impinge on the substrate with relatively high energy. A distinction is made between direct and reactive cathode sputtering. In the direct cathode sputtering process, the target material is applied directly to the substrate. For reactive cathode sputtering, a gaseous component is added to the argon operating gas, which reacts with the sputtered target material. For example, a molybdenum intermediate layer is produced by sputtering a molybdenum target, while for the precipitation of a titanium nitride hard substance layer one operates in an argon-nitrogen mixture containing approximately 5% nitrogen. The titanium sputtered from the titanium target reacts with the nitrogen to form titanium nitride, which forms a titanium nitride hard substance layer on the substrate.

For comparison purpose some samples were prepared using the Chemical Vapour Deposition method. In contrast to the described PVD-method in CVD the titanium necessary for the formation of a coating of titanium carbide or titanium nitride is supplied by gaseous titanium tetrachloride. In particular I applied the following temperatures and gas mixtures to provide the cemented carbides with a coating consisting of an inner titanium carbide layer and an outer titanium nitride layer:

| layer | temperature °C. | gases (Volume - %) $TiCl_4$ | $CH_4$ | $N_2$ | $H_2$ |
|---|---|---|---|---|---|
| TiC | 1020 | 2,3 | 5 | — | 92.7 |
| TiN | 990 | 1,5 | — | 30 | 68.5 |

After a time of four hours a coating of titanium carbide (2.5 μm thickness) and titanium nitride (5 μm thickness) were formed.

It is surprising to one skilled in the art that the coated metal carbide body of the invention having a metallic intermediate layer comprising molybdenum and/or tungsten has wear characteristics that make it useful in making tools for the machining or shaping by non-cutting means of metal workpieces. From Swiss Pat. No. 542,678, one would be led to believe that the wear resistance of the metal-free hard substance layers would have been reduced by the presence of the metallic intermediate layer.

One of ordinary skill in the art would know that the microhardness of an intermediate layer of molybdenum and/or tungsten is substantially less than the microhardness of the hard substances and metal carbides. For example, a molybdenum intermediate layer has a microhardness of 160 to 190 HV (Vickers Hardness), while the metal carbide substrate (WC-7Co) has a microhardness of 1800 to 1900 HV and a TiN hard substance layer has a microhardness of 2000 to 2200 HV. Since a nickel intermediate layer whose micrhardness lies at 190 HV was found to be unsuitable, the person of ordinary skill in the art would have been taught away from employing intermediate layers of molybdenum and/or tungsten.

The invention will now be described in greater detail with reference to examples.

In the examples below, metal carbide basic bodies were employed which were in the form of reversible cutting plates having the geometric shape known as SNUN 120408 (Standard 15Q883) and were manufactured from metal carbide M15 [composition, in weight percent: 82.5% WC, 11% (TiC, TaC and NbC) and 6.5% Co.]

EXAMPLE 1

The reversible cutting plate was treated in a CVD system at an initial temperature of 1020° C. with a gas mixture of titanium tetrachloride, methane and hydrogen. After 60 minutes, the temperature was reduced to 990° C. and methane was replaced by nitrogen. After a total of 180 minutes, the furnace heat was switched off and the reversible cutting plate was cooled in a stream of hydrogen. By means of a metallographic microsection, it was determined that a double hard substance layer of titanium carbide and titanium nitride having a total thickness of 7.5 μm had formed on the metal carbide reversible cutting plate.

EXAMPLE 2

In a cathode sputtering system, a reversible cutting plate at a temperature of 350° C. was treated by reactively cathode sputtering a titanium target (cathode) in a gas atmosphere of 10 volume percent nitrogen and 90 volume percent argon at a pressure of 1 Pascal to precipitate a titanium nitride layer having a thickness of 7.2 μm.

EXAMPLE 3

An 0.6 μm nickel intermediate layer was produced on a reversible cutting plate by direct cathode sputtering of a nickel target in an argon atmosphere, with the reversible cutting plate having a temperature of about 400° C. Thereafter, a titanium nitride layer was applied to the nickel intermediate layer as described in Example 2.

EXAMPLE 4

A molybdenum intermediate layer having a thickness of 0.6 μm was precipitated onto the reversible cutting plate by the cathode sputtering of a molybdenum target in an argon atmosphere. During the precipitation of the molybdenum intermediate layer, the reversible cutting plate had a temperature of about 400° C. Thereafter, a 7.0 μm titanium nitride hard substance layer was applied to the molybdenum intermediate layer in the manner described in Example 2.

After application of the coatings, the reversible cutting plate was examined by metallographic methods, layer thicknesses were measured and the quality of the bond between the basic bodies and the layers was evaluated. With the aid of a scratch test in which a conical diamond tip was drawn across the layer with increasing pressure, it was possible to determine a quantitative adhesion value, the so-called critical load. Finally, the cutting ability of the coated reversible cutting plates was determined on a test lathe by cutting a shaft made of C60 steel. (according standard AISI 1060, Brinell hardness 300 HB).

The results of the tests are shown in Table 1. In the scratch test, the reversible cutting plate coated according to Example 1 in a CVD process reached a critical load of 4.5 kg. In the cutting test, a crater depth of 25 μm was reached after 12 minutes of rotation as well as a wear mark width of 0.15 mm. The reversible cutting plate coated according to Example 2 had a critical load of only 2.5 kg. In the cutting test, the lower layer adhesion resulted in greater crater wear and a greater wear mark width. After the cutting test, chipping of the layers was observed on the reversible cutting plate coated according to Example 2. Already, after 2 minutes of rotation, the reversible cutting plate according to Example 3 displayed such great crater wear that the cutting test was interrupted.

The reversible cutting plate according to the present invention, as described in Example 4, had a high critical load, thus demonstrating high adhesion of the hard substance layer. With respect to its wear characteristics, this reversible cutting plate was superior to the comparison plate of Example 1. With the present invention, it is thus possible to achieve the same or better adhesion and wear characteristics with a low coating temperature than is possible with reversible cutting plates coated according to the CVD process. Due to the low process temperatures of the process according to the invention, metal carbide tools can now be coated which could not be coated in the past due to the high temperatures involved in the CVD process, such as, for example, high precision parts that are subject to warping and soldered metal carbide parts.

EXAMPLE 5

A reversible cutting plate was coated by direct cathode sputtering with a molybdenum intermediate layer and subsequently by reactive cathode sputtering with a 2 μm aluminum oxide layer. During the two coating processes, the temperature of the metal carbide basic body was about 400° C. The critical load of the thus coated reversible cutting plate was determined to be 6 kg.

For comparison an otherwise identical cutting plate was prepared without the molybdenum intermediate layer, resulting in a cutting plate with a critical load of 1.5 kg.

EXAMPLE 6

Under the conditions stated in Example 4, a reversible cutting plate was coated with an intermediate layer of a molybdenum alloy composed of 0.07% zirconium, 0.5% titanium, the remainder being molybdenum. This intermediate layer also imparted good adhesion and good wear characteristics to the subsequently applied titanium nitride hard substance layer.

The above examples are provided for purposes of illustration and not to limit the invention, which is intended to include all modifications, adaptations and equivalents within the scope of the appended claims.

TABLE 1

| Example No. | Layer | Thickness [μm] | Critical Load [kg] | Cutting Test* Time [min] | KT [μm] | VB [mm] |
|---|---|---|---|---|---|---|
| 1 | TiC and TiN (by CVD) | 7.5 | 4.5 | 12 | 25 | 0.15 |
| 2 | TiN | 7.2 | 2.5 | 12 | 57 | 0.68 |
| 3 | Ni and TiN | 0.6 7.2 | 2.0 | 2 | 63 | 0.25 |
| 4 | Mo and TiN | 0.6 7.0 | 5.5 | 12 | 12 | 0.17 |

*KT = crater depth, VB = wear mark depth
Workpiece material: C60 N steel
Feed: 0.28 mm/revolution
Cutting speed: 180 m/min
Cutting depth: 1.5 mm

What is claimed is:

1. A wear resistant, coated, metal carbide body comprising a metal carbide basic body, a metallic intermediate layer and at least one metal-free hard substance layer, wherein the metallic intermediate layer comprises at least one metal selected from the group consisting of molybdenum and tungsten and has a thickness of from about 0.1 to 2 μm, said metallic intermediate layer having been applied to the metal carbide basic body by a physical vapor deposition process in which the metal carbide basic body is maintained at a temperature of from 200° to 600° C. during the deposition of the intermediate layer.

2. The metal carbide body of claim 1, wherein the intermediate layer comprises molybdenum.

3. The metal carbide body of claim 1, wherein the intermediate layer comprises tungsten.

4. The metal carbide body of claim 1, wherein the intermediate layer comprises both molybdenum and tungsten.

5. The metal carbide body of claim 1, wherein the metallic intermediate layer has been applied to the metal carbide basic body by direct cathode sputtering.

6. The metal carbide body of claim 1, wherein the metallic intermediate layer comprises 0.1 to 49 weight percent of at least one metal selected from the group consisting of titanium, zirconium, hafnium, niobium and tantalum.

7. The metal carbide body of claim 1, wherein the metal-free hard substance layers comprise at least one hard substance selected from the group consisting of titanium carbide, titanium nitride, titanium carbonitride, aluminum oxide, zirconium oxide, boron carbide, silicon carbide, titanium diboride.

8. The metal carbide body of claim 1, wherein the metal-free hard substance layers comprise at least one hard substance selected from the group consisting of titanium carbide, titanium nitride, titanium carbonitride and aluminum oxide.

9. A process for producing the wear resistant, coated, metal carbide body of claim 1, comprising applying a metallic intermediate layer onto the metal carbide basic body by a physical vapor deposition process, during the deposition of which the metal carbide basic body is maintained at a temperature of from about 200° to 600° C., and applying at least one metal-free hard substance layer onto the metallic intermediate layer by known means.

10. The process of claim 9, wherein the metallic intermediate layer is applied to the metal carbide basic body by direct cathode sputtering.

11. The process of claim 9, wherein at least one metal-free hard substance layer is applied to the metallic intermediate layer by reactive cathode sputtering.

12. The process of claim 9, wherein at least one metal-free hard substance layer is applied to the metallic intermediate layer by gas phase reaction.

* * * * *